US011459714B2

(12) United States Patent
Powell et al.

(10) Patent No.: US 11,459,714 B2
(45) Date of Patent: Oct. 4, 2022

(54) GUARDRAIL POST SYSTEM

(71) Applicant: Vandorf GR1 Inc., Stouffville (CA)

(72) Inventors: Benjamin Fraser Powell, King City (CA); Dean Clinton Alberson, Bryan, TX (US); Mohammad Talha Ghuman, Oakville (CA)

(73) Assignee: Vandorf GR1 Inc., Stouffville (CA)

( * ) Notice: Subject to any disclaimer, the term of this patent is extended or adjusted under 35 U.S.C. 154(b) by 453 days.

(21) Appl. No.: 16/742,717

(22) Filed: Jan. 14, 2020

(65) Prior Publication Data

US 2021/0214904 A1 Jul. 15, 2021

(51) Int. Cl.
*E01F 15/04* (2006.01)
*E04H 12/22* (2006.01)

(52) U.S. Cl.
CPC ..... *E01F 15/0484* (2013.01); *E01F 15/0461* (2013.01); *E04H 12/2269* (2013.01)

(58) Field of Classification Search
CPC .... E04H 12/2253; E04H 12/2269; E01F 9/60; E01F 9/623; E01F 9/631; E01F 9/635; E01F 9/658; E01F 9/673; E01F 9/681; E01F 9/685; E01F 15/0461; E01F 15/0484
See application file for complete search history.

(56) References Cited

U.S. PATENT DOCUMENTS 3,628,296 A * 12/1971 Henry ..... E01F 9/635 52/298
3,820,906 A * 6/1974 Katt ..... F16B 7/0426 403/312
4,252,472 A 2/1981 Moraly
4,615,156 A * 10/1986 Deike ..... E04H 12/2215 52/153
4,858,876 A * 8/1989 Moreno ..... E04H 12/2223 248/548
4,921,200 A 5/1990 Moraly
5,125,194 A 6/1992 Granger
RE35,133 E * 12/1995 Halloran, Jr. ..... E01F 9/685 405/253

(Continued)

FOREIGN PATENT DOCUMENTS

FR 2737525 A1 * 2/1997 ..... E01F 9/685
KR 101132807 B1 * 4/2012

(Continued)

*Primary Examiner* — Jonathan P Masinick

(74) *Attorney, Agent, or Firm* — John G. Fischer, Esq.; Scheef & Stone, L.L.P.

(57) ABSTRACT

A subterranean housing and post system for connection to a traffic guardrail is disclosed. The housing comprises an interior space and a soil plate extending outward from the housing. The interior of the housing comprises a lower post guide, a lower post stop, and an upper post stop. A lower post has a U-channel shape with outwardly extending flanges. The lower post is insertable into the lower end of the housing, between the lower post guide and the housing body, with insertion limited by engagement with the lower post stop. An upper post has a U-channel shape with outwardly extending flanges. The upper post is insertable into the upper end of the housing, between the lower post and the housing body. Insertion of the upper post is limited by engagement with the upper post stop. The upper post is connectable to a guardrail.

49 Claims, 14 Drawing Sheets

(56) References Cited

U.S. PATENT DOCUMENTS

| | | | | | |
|---|---|---|---|---|---|
| 5,480,121 | A * | 1/1996 | Rice | E01F 9/635 | 248/548 |
| 5,689,918 | A * | 11/1997 | Johnson | E04H 12/2215 | 52/153 |
| 5,887,842 | A * | 3/1999 | Granger | E01F 9/635 | 248/548 |
| 6,113,055 | A * | 9/2000 | Salman | E01F 9/635 | 248/548 |
| 6,343,446 | B1 * | 2/2002 | Beard | E02D 27/42 | 52/165 |
| 6,398,192 | B1 | 6/2002 | Albritton | | |
| 6,488,268 | B1 | 12/2002 | Albritton | | |
| 6,793,204 | B2 | 9/2004 | Albritton | | |
| 6,886,813 | B2 | 5/2005 | Albritton | | |
| 7,185,461 | B2 | 3/2007 | Lapointe et al. | | |
| 7,713,003 | B2 * | 5/2010 | Agg | E02D 5/74 | 52/156 |
| 7,779,589 | B2 * | 8/2010 | Salman | E01F 9/685 | 52/165 |
| 7,878,485 | B2 * | 2/2011 | Conway | E01F 15/0438 | 404/9 |
| 8,038,126 | B1 | 10/2011 | Albritton | | |
| 8,858,112 | B2 * | 10/2014 | Wallace | E01F 15/0461 | 404/9 |
| 9,863,106 | B2 * | 1/2018 | Conway | E01F 15/0423 | |

FOREIGN PATENT DOCUMENTS

| | | | |
|---|---|---|---|
| KR | 101286047 | B1 * | 7/2013 |
| KR | 101294696 | B1 * | 8/2013 |
| KR | 102293464 | B1 * | 8/2021 |

* cited by examiner

GUARDRAIL POST SYSTEM

RELATED APPLICATION

None.

FIELD OF THE DISCLOSURE

This disclosure relates to a subterranean housing and post system for connection to a traffic guardrail for preventing vehicles from leaving the roadway.

BACKGROUND

Current post supported guardrail designs employ posts driven deep into the ground at regular intervals. The posts are forcibly installed and then connected to a horizontal guardrail system. The posts are driven sufficiently deep to provide strong support to the guardrail to encourage vehicles back onto the roadway. The posts resist breakage when vehicles collide with the guardrails. When the impact is sufficiently large, the posts will break off.

One disadvantage of current post supported guardrail designs is that the failure of the post leaves the public roadway managers with the task of digging up the broken post and replacing it. Another disadvantage of current post supported guardrail designs is that prior to digging up the broken post, it is necessary to engage and schedule the appearance of specialized utility locators to identify any underground utilities such as cables, gas lines, water lines, and electrical lines before digging a new post hole, or even when attempting to use the same post hole. This is a costly and time consuming process that increases the cost of road maintenance to taxpayers and leaves the public at risk for longer periods of time before the repair task can be completed.

Another disadvantage of current post supported guardrail designs is that removal of the broken post may weaken the soil support for the replacement post. Another disadvantage of current post supported guardrail designs is that they may require, in the alternative to removal of the broken post, location of one or more new post positions, which again requires the use of utility locators in advance. A disadvantage of this alternative is the additional costs of additional post installation, or if using the same number of post installations, disrupting the original distribution of posts for attachment to the guardrail. This disruption itself may require additional posts to replace broken posts, and may weaken the designed structural strength of the system, and thereby deviate from the crash tested specification.

Another disadvantage of the current post supported guardrail systems is that they fail irregularly in very cold weather environments. The posts tend to rise up from the soil due to frost heave and will not perform to specification.

Another disadvantage of current post supported guardrail designs is that they can be improperly assembled, wasting time and materials and posing a risk to the public because the guardrail system is incorrectly assembled.

Another disadvantage of current post supported guardrail designs is that conventional systems rely on I-beams, round wood, and square wood posts which limit the ability to customize the systems assembly and performance characteristics.

There is a need for a post supported guardrail design that is economical to build and install. There is also a need for a post supported guardrail design that has a controllable breakage of the rail post. There is also a need for a post supported guardrail design that does not require utility location for repair. There is also a need for a post supported guardrail system that is easy to assemble, cannot be assembled incorrectly, and that provides for the proper assembled relationship between components. There is also a need for a system with these capabilities to be affordable and reliable.

An advantage of the embodiments of the present invention is that they provide a post supported guardrail design that is economical to build and install. Another advantage of these embodiments is that they provide a system having a controllable breakage of the rail post. Another advantage of these embodiments is that they provide a guard rail system that does not require utility location for repair.

Another advantage of these embodiments is that they provide a system that prevents incorrect assembly. Another advantage of these embodiments is that they provide a system that provides for the proper assembled relationship between components. Another advantage of these embodiments is that they provide a system that provides these capabilities to be affordable and reliable.

In summary, the disclosed invention provides a unique solution to the engineering constraints and challenges of providing a post supported guardrail design that safely and economically redirects traffic while being quickly and efficiently repairable, and that overcomes the aforementioned and other disadvantages of the current systems.

The advantages and features of the embodiments presently disclosed will become more readily understood from the following detailed description and appended claims when read in conjunction with the accompanying drawings in which like numerals represent like elements.

SUMMARY

For the purposes of this disclosure, a U-channel shape refers to the general shape of a post U-channel, such as the shape of U-channel posts used in the traffic industry for signs and for supporting guard rails. It is intended to refer generally, but not limited to, the shape of the lower and upper posts disclosed in the drawings.

A subterranean housing and post system for connection to a traffic guardrail is disclosed. In one embodiment, the guardrail post system comprises housing. The housing comprises a lower end and an upper end, an interior space, and a soil plate extending outward from the lower end of the housing. The interior of the housing comprises a lower post guide, a lower post stop, and an upper post stop.

A lower post is provided, having a U-channel shape with outwardly extending flanges on its ends. The lower post is insertable into the interior space at the lower end of the housing, between the lower post guide and the housing body. Insertion of the lower post is limited by engagement with the lower post stop.

An upper post is provided, having a U-channel shape with outwardly extending flanges on its ends. The upper post is insertable into the interior space at the upper end of the housing, between the lower post and the housing body, and also as between a brace and the housing body. Insertion of the upper post is limited by engagement with the upper post stop. The upper post is then connectable to a guardrail.

In another embodiment, a housing orifice extends through the housing body. A lower post orifice is located on the top end of the lower post. A housing fastener is insertable through the housing orifice and the lower post orifice to secure the lower post against the lower post stop.

In another embodiment, a lower post block is formed on the interior of the housing to prevent reversed insertion of the lower post. In another embodiment, a slot is formed on a lower end of the upper post. The slot is slidingly engageable over the fastener to permit full insertion of the upper post into the housing.

In another embodiment, the upper post stop is formed on an upper end surface of the lower post guide. In another embodiment, a brace on the interior of the housing acts as a guide for the upper post and provides controlled deformation of the upper post on impact. In another embodiment, the brace forms the lower post stop and the lower post and housing are driven into the ground by percussive force applied to the brace and upper end of the lower post.

In another embodiment, the housing further comprises a pair of side walls extending perpendicularly upwards from the soil plate. An outer wall spans between the side walls and has a centrally located longitudinal recess. The recess extends into the U-channel of the upper post when the upper post is inserted into the housing to prevent improper insertion of the upper post and to limit rotation and misalignment of the upper post relative to the housing.

In another embodiment, the lower end of the housing is beveled to facilitate insertion into the soil. In another embodiment, the soil plate has a lower end and an upper end. The lower end of the soil plate has chamfered edges to facilitate insertion into the soil. In another embodiment, the soil plate has a lower end and an upper end. The upper end of the soil plate is located between the lower end and upper end of the housing. A collar portion of the housing extends above the soil plate.

In another embodiment, a brace on the interior of the housing forms both the lower post stop and the upper post guide. In another embodiment, a collar portion of the housing above the soil plate has a collar support with a thickened cross-section that may act as a brace for bending the upper post on activation.

In another embodiment, the upper post extends between 3 inches and 5 inches into the housing. In another embodiment, the upper post extends at least 4 inches into the housing.

In another embodiment, the lower post is made of a heavier (per foot) steel ribbed U-channel than the upper post steel ribbed U-channel.

In another embodiment, the lower post is made of a 5 lb. per foot steel ribbed U-channel. In another embodiment, the upper post is made of a 4 lb. per foot steel ribbed U-channel.

In another embodiment, the upper post is comprised of a higher carbon steel than the housing to permit a predicatable and controlled failure of the upper post rather than failure of the housing.

In another embodiment, the housing has a higher tensile strength than the upper post; and the higher tensile strength of the housing resists bending during insertion and activation.

In another embodiment, the lower post, upper post, and housing are all galvanized.

DETAILED DESCRIPTION

The following description is presented to enable any person skilled in the art to make and use the invention and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
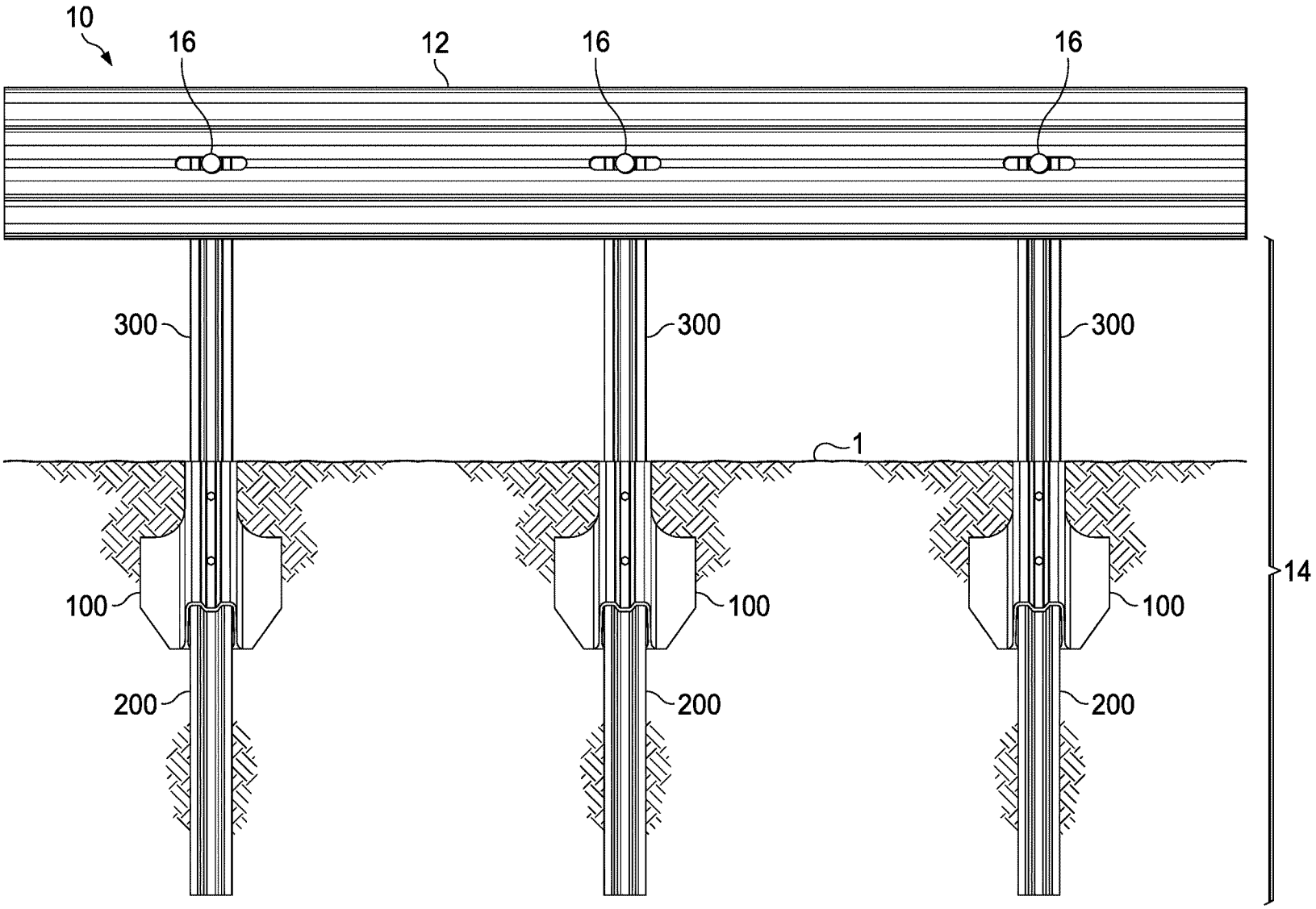
FIG. 1 is a front view of a guardrail housing and post system in accordance with an embodiment of the invention.

FIG. 1 is a front view of a guardrail system 10 featuring a guardrail housing and post system 14 in accordance with an embodiment of the invention. Guardrail housing and post system 14 comprises a housing 100, a lower post 200, and an upper post 300. Lower post 200 is inserted into housing 100. Housing 100 and lower post 200 form a subassembly that is driven into the ground to groundlevel 1. This may be accomplished with a percussive hammer or other suitable means. Upper post 300 is installed in housing 100. Guardrail 12 is affixed to upper post 300 with fasteners 16 to complete guardrail system 10.

Figure 2:
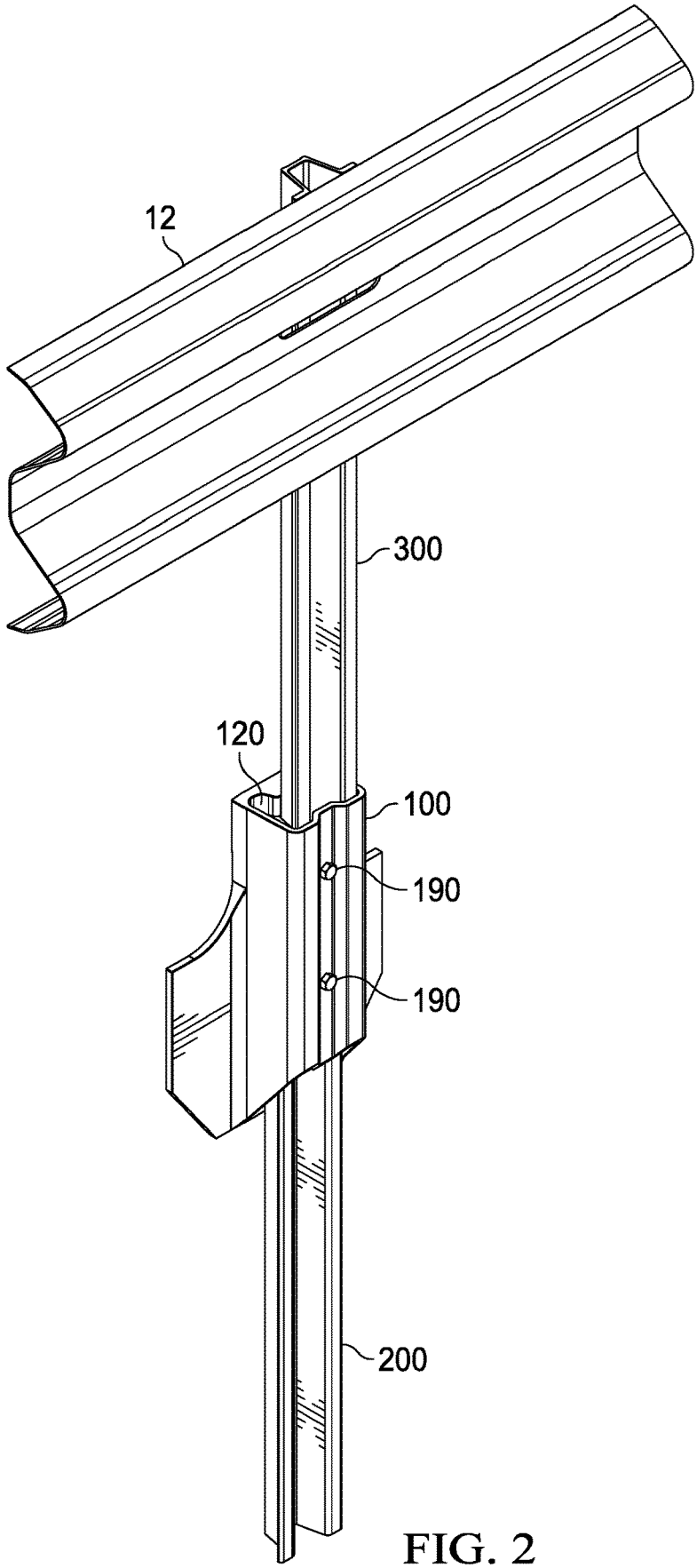
FIG. 2 is an isometric view of the guardrail housing and post system illustrated in FIG. 1.

FIG. 2 is an isometric view of guardrail system 10 illustrated in FIG. 1. As seen in this view, one or more housing fasteners 190 may be used to secure lower post 200 in position in housing 100 before the housing 100—lower post 200 subassembly is driven into the ground.

Figure 3:
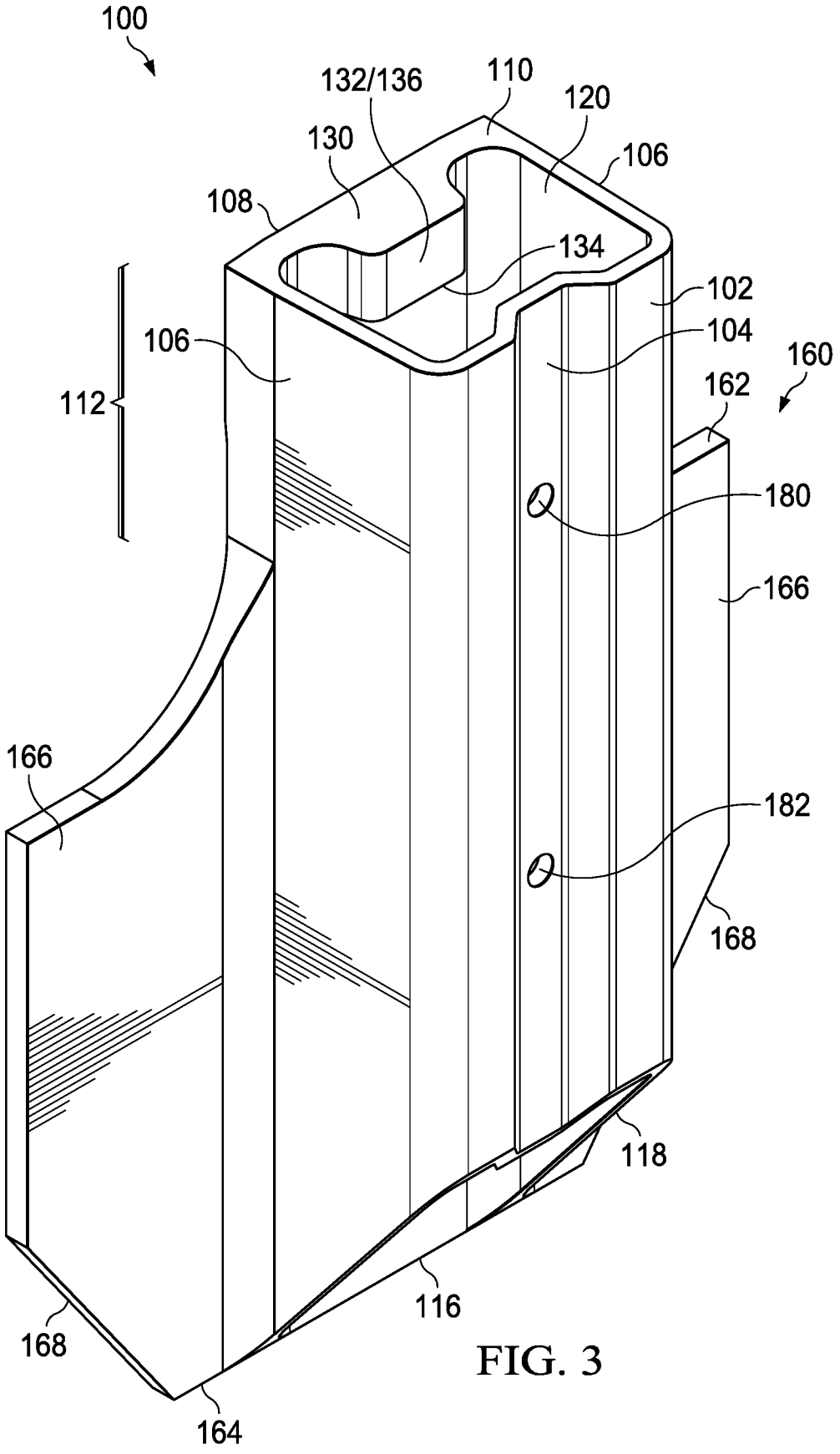
FIG. 3 is an isometric view of an embodiment of the housing of the guardrail housing and post system illustrated in FIGS. 1 and 2.

FIG. 3 is an isometric view of an embodiment of housing 100 of guardrail housing and post system 14 illustrated in FIGS. 1 and 2. As seen in FIG. 3, housing 100 has a front wall 102, opposing side walls 106, and a back side 108, which together form an interior space 120.

In one embodiment, front wall 102 has a longitudinal recess 104. Housing 100 may have one or more housing orifices 180, 182 for receiving housing fasteners 190 to provide a secure connection to lower post 200.

Housing 100 has an upper end 110 and an opposite lower end 116. Upper end 110 may have a collar 112. A collar support 114 may be located at upper end 110 and on collar 112 if provided. Lower end 116 may have a bevel 118 to facilitate insertion into the soil.

Interior space 120 of housing 100 has a lower post stop 134 to register the full insertion point of lower post 200. Interior space 120 of housing 100 has a brace 136 to act as a fulcrum for controlled failure of upper post 300 on impact of guardrail system 10 with a vehicle. Interior space 120 of housing 100 may optionally have an upper post guide 132 to provide parallel sliding insertion and positioning of upper post 300 in housing 100. As illustrated in FIG. 3, brace 136 may comprise a surface for functioning as upper post guide 132.

In an alternative embodiment illustrated in FIG. 3, interior space 120 of housing 100 has an upper guide-stop 130 that comprises lower post stop 134, upper post guide 132, and brace 136, and provides the functions and benefits of each.

Interior space 120 of housing 100 has a lower post guide 144 (see FIG. 6) to provide parallel sliding insertion and positioning of lower post 200 in housing 100. Lower post guide 144 may be bifurcated for location adjacent to front wall 102 and opposing side walls 106 of interior space 120 of housing 100.

Interior space 120 of housing 100 has an upper post stop 142 (see FIG. 6) to register the full insertion point of upper post 300. Upper post stop 142 may be singular or may be bifurcated for location adjacent to front wall 102 and opposing side walls 106 of interior space 120 of housing 100.

Figure 7:
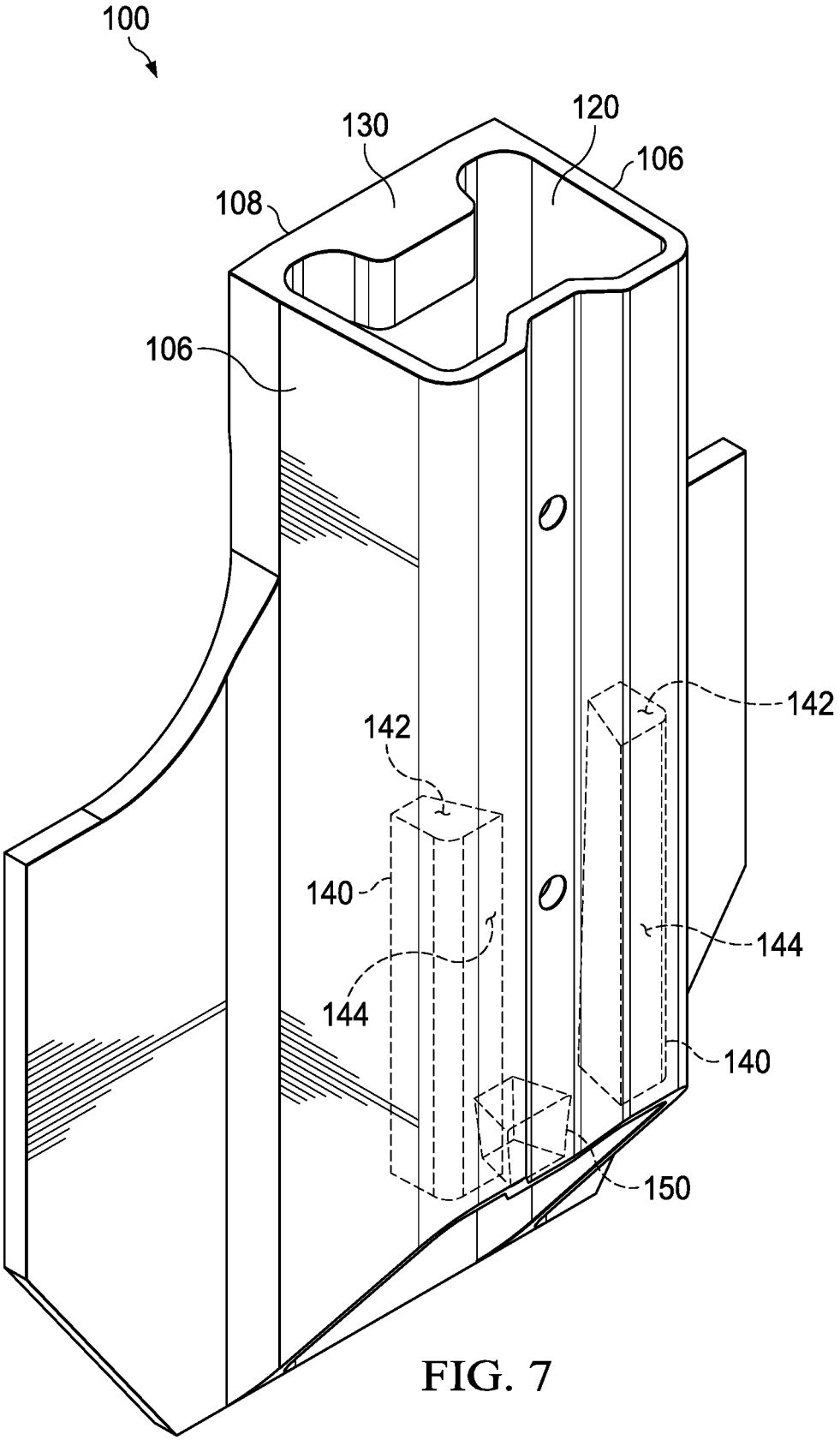
FIG. 7 is an isometric view of an alternative embodiment to the housing of FIG. 6.

In an alternative embodiment, interior space 120 of housing 100 has a lower guide-stop 140 that comprises an upper post stop 142 and a lower post guide 144, and provides the functions and benefits of each (see FIG. 7). Lower guide-stop 140 may be bifurcated for location adjacent to front wall 102 and opposing side walls 106 of interior space 120 of housing 100.

Housing 100 has a soil plate 160 formed or attached to its back side 108. Soil plate 160 has an upper end 162, and an opposite lower end 164. Spades 166 extend outward from each side of housing 100. Spades 166 may have a chamfered end 168 to facilitate insertion into the soil.

Figure 4:
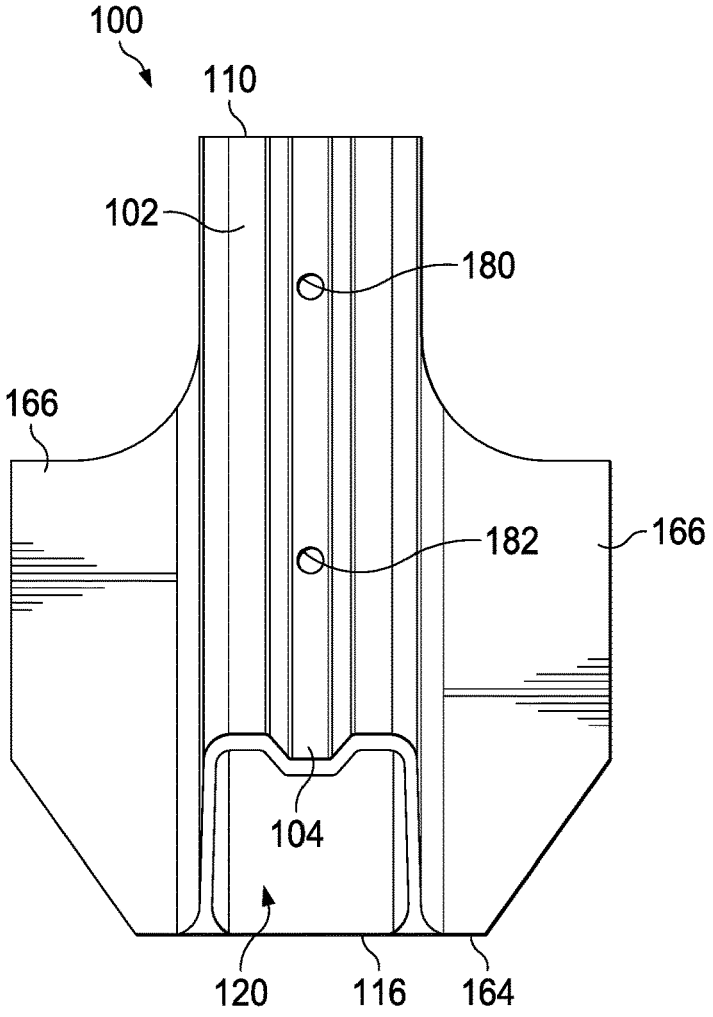
FIG. 4 is a front view of the embodiment of the housing illustrated in FIG. 3.
Figure 5:
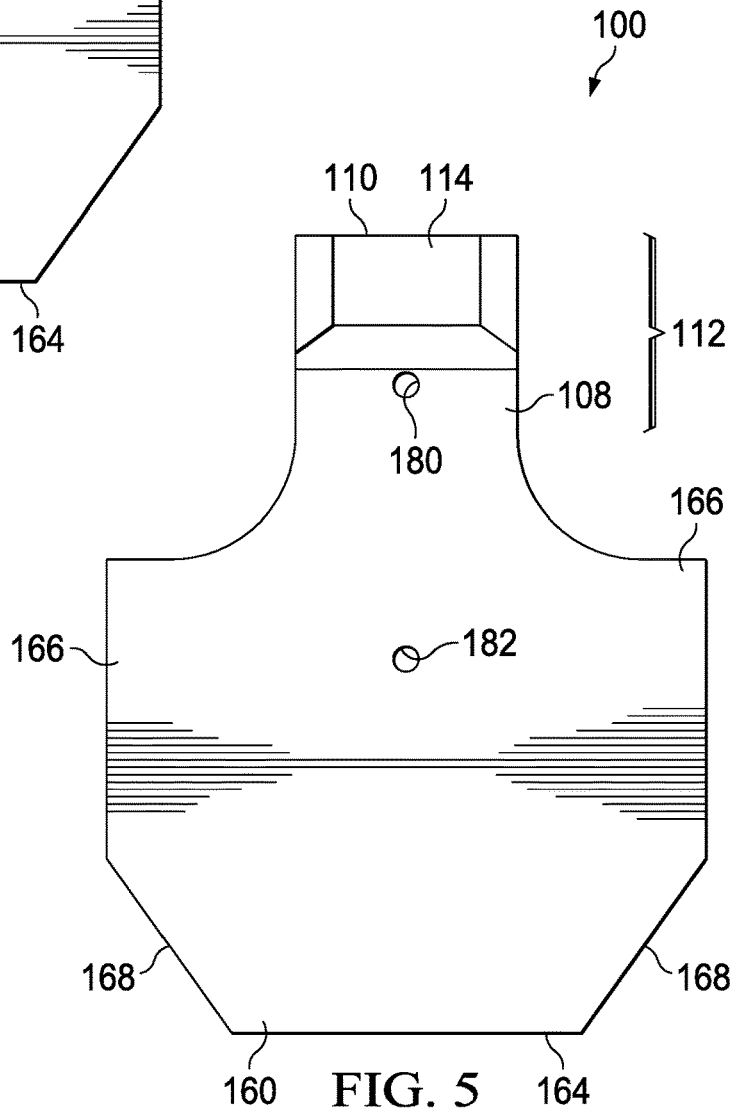
FIG. 5 is a rear view of the embodiment of the housing illustrated in FIG. 3.

FIG. 4 is a front view of the embodiment of housing 100 illustrated in FIG. 3. FIG. 5 is a rear view of the embodiment of housing 100 illustrated in FIG. 3. As best seen in FIGS. 4 and 5, housing 100 may have one or more housing orifices 180, 182 extending through front wall 102 and back side 108. In the embodiment illustrated, an upper housing orifice 180 extends through front wall 102 and back side 108 at collar 112. A lower housing orifice 182 extends through front wall 102 and back side 108 at soil plate 160.

Figure 6:
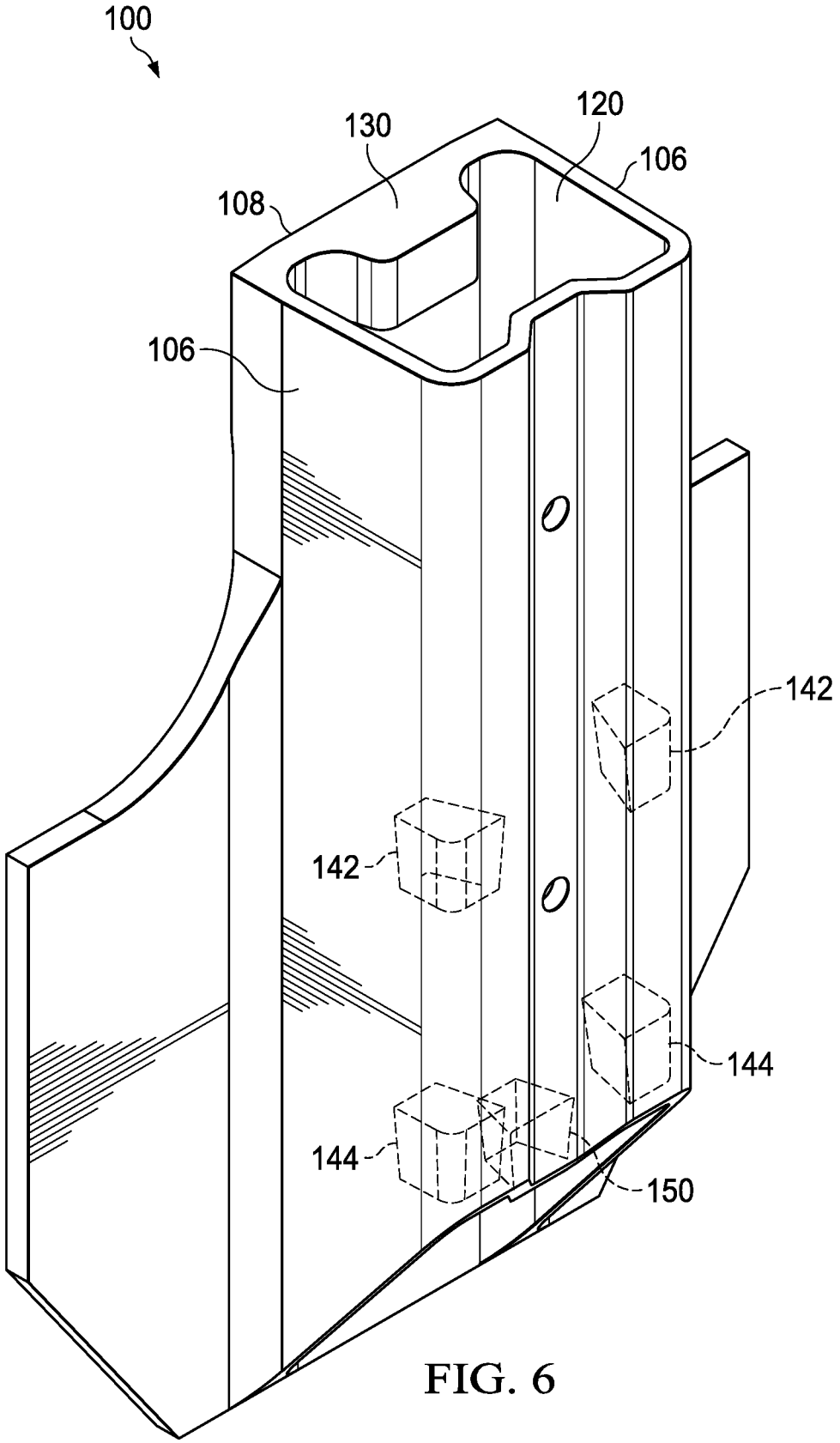
FIG. 6 is an isometric view of the housing of the guardrail housing and post system illustrated in FIGS. 1 and 2.

FIG. 6 is an isometric view of housing 100 of guardrail housing and post system 14 illustrated in FIGS. 1 and 2, illustrating elements within interior space 120 in hidden lines. As seen in FIG. 6, interior space 120 of housing 100 has a lower post guide 144 to provide parallel sliding insertion and positioning of lower post 200 in housing 100. Lower post guide 144 may be bifurcated for location adjacent to front wall 102 and opposing side walls 106 of interior space 120 of housing 100.

Interior space 120 of housing 100 has an upper post stop 142 to register the full insertion point of upper post 300. Upper post stop 142 may be singular or may be bifurcated for location adjacent to front wall 102 and opposing side walls 106 of interior space 120 of housing 100. Optionally, interior space 120 of housing 100 has a lower post block 150 to prevent reversed insertion of lower post 200 into housing interior 120.

FIG. 7 is an isometric view of an alternative embodiment to housing 100 of FIG. 6, illustrating elements within interior space 120 in hidden lines. In this embodiment, interior space 120 of housing 100 has an upper guide-stop 130 that comprises a lower post stop 134 an upper post guide 132, and brace 136, and provides the functions and benefits of each.

As also illustrated in FIG. 7, interior space 120 of housing 100 has a lower guide-stop 140 that comprises an upper post stop 142 and a lower post guide 144, and provides the functions and benefits of each. Lower guide-stop 140 is bifurcated for location adjacent opposing side walls 106 of interior space 120 of housing 100. Lower guide-stop 140 is illustrated in hidden lines. Optionally, interior space 120 of housing 100 has a lower post block 150 to prevent reversed insertion of lower post 200 into housing interior 120.

Figure 8:
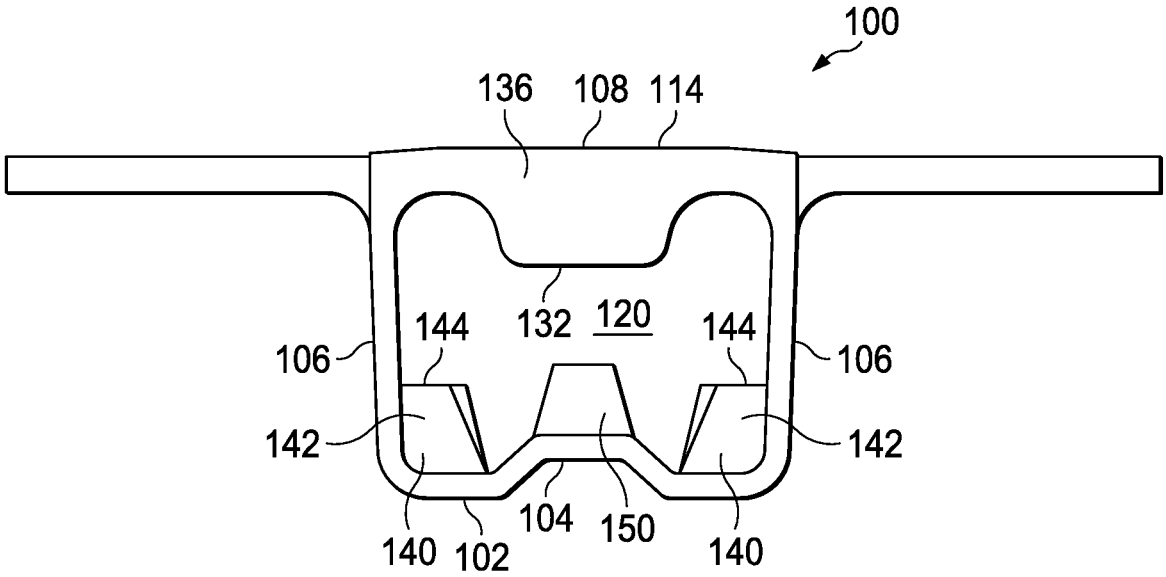
FIG. 8 is a top view of the embodiment of the housing of FIGS. 3 and 6.

FIG. 8 is a top view of the embodiment of the housing of FIGS. 3 and 6. Looking down on housing 100, collar support 114 protrudes outward from back side 108. Longitudinal recess 104 protrudes inwards into interior space 120. Brace 136 is located at upper end 110 of housing 100 and protrudes into housing interior 120. Brace 136 may serve as an optional upper post guide 132 if desired.

Within housing interior 120, below and opposite to brace 136, upper post stop 142 is shown in two places; positioned against front wall 102 and on each side wall 106. Still lower within interior space 120, and shown behind upper post stop 142 in this view, lower post guide 144 is shown in two places, positioned against front wall 102 and on each side wall 106. In this embodiment, upper post stop 142 and lower post guide 144 are separate elements.

Figure 9:
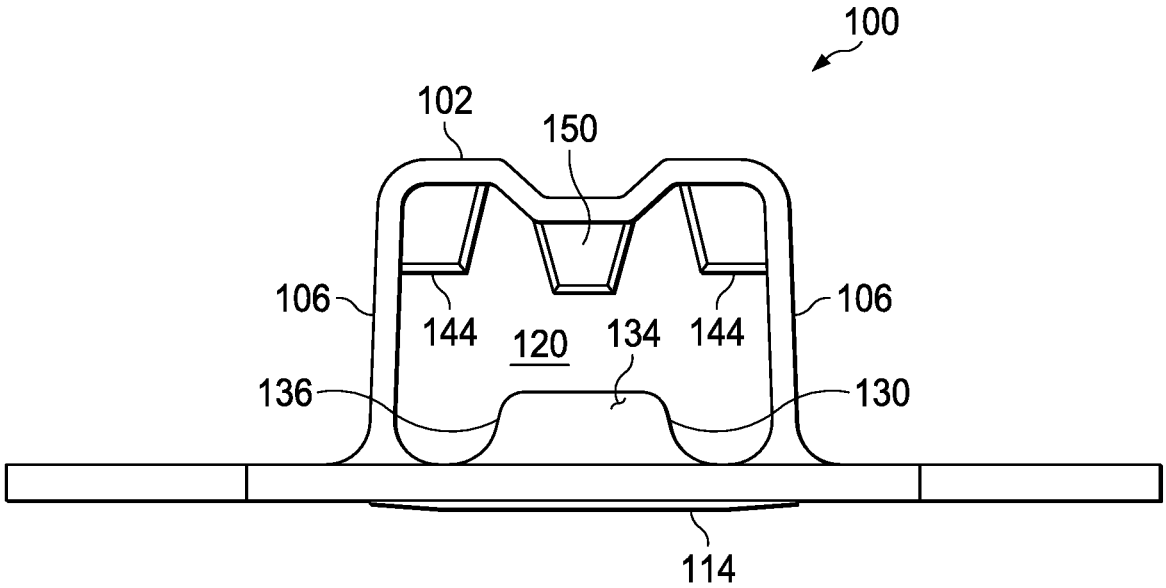
FIG. 9 is a bottom view of the embodiment of the housing of FIG. 8.

FIG. 9 is a bottom view of the embodiment of housing 100 of FIG. 8. In this view, lower post stop 134 is visible. In the embodiment illustrated, lower post stop 134 is formed on the lower surface of brace 136. As illustrated, lower post stop 134 and upper post guide 132 are formed on brace 136. In this embodiment, the element designed to provide these combined element features is referred to as upper guide-stop 130. As also seen in this view, lower post guides 144 properly orientate lower post 200 for insertion and engagement with lower post stop 134.

Longitudinal recess 104 protrudes inward into interior space 120. Lower post block 150 is located inside interior space 120 of housing 100, adjacent to longitudinal recess 104. Lower post block 150 advantageously prevents reversed insertion of lower post 200 into housing 100.

Figure 10:
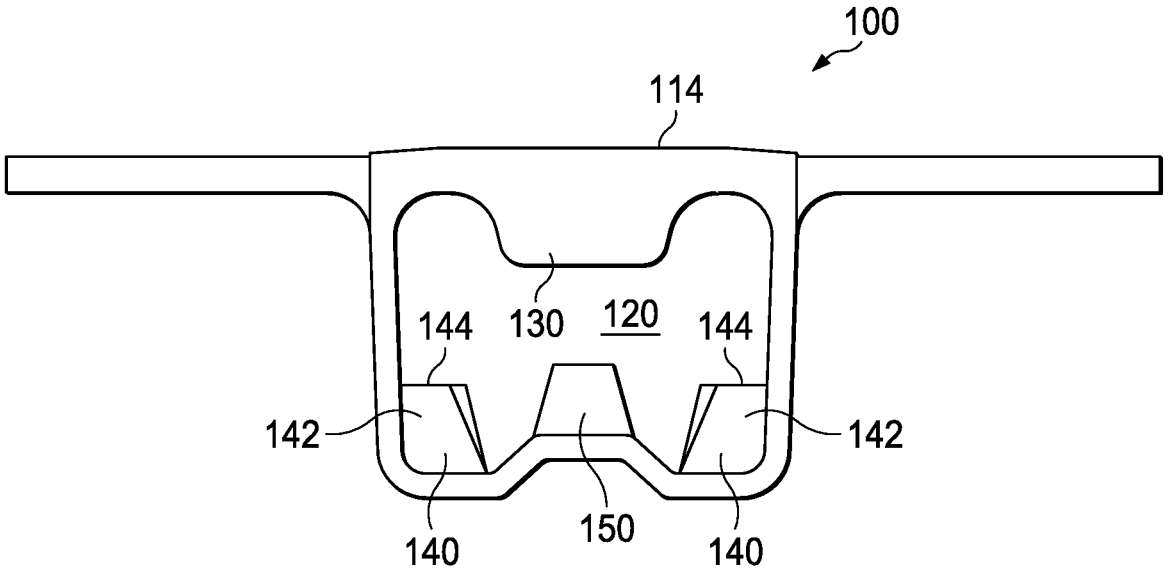
FIG. 10 is a top view of the embodiment of the housing of FIGS. 3 and 7.

FIG. 10 is a top view of the embodiment of housing 100 of FIGS. 3 and 7. Looking down on housing 100, collar support 114 protrudes outward from back side 108. Upper guide-stop 130 is located at upper end 110 of housing 100 and protrudes into housing interior 120. Upper guide-stop 130 comprises brace 136 and lower post stop 134, and may also include upper post guide 132 (see FIG. 11).

Figure 11:
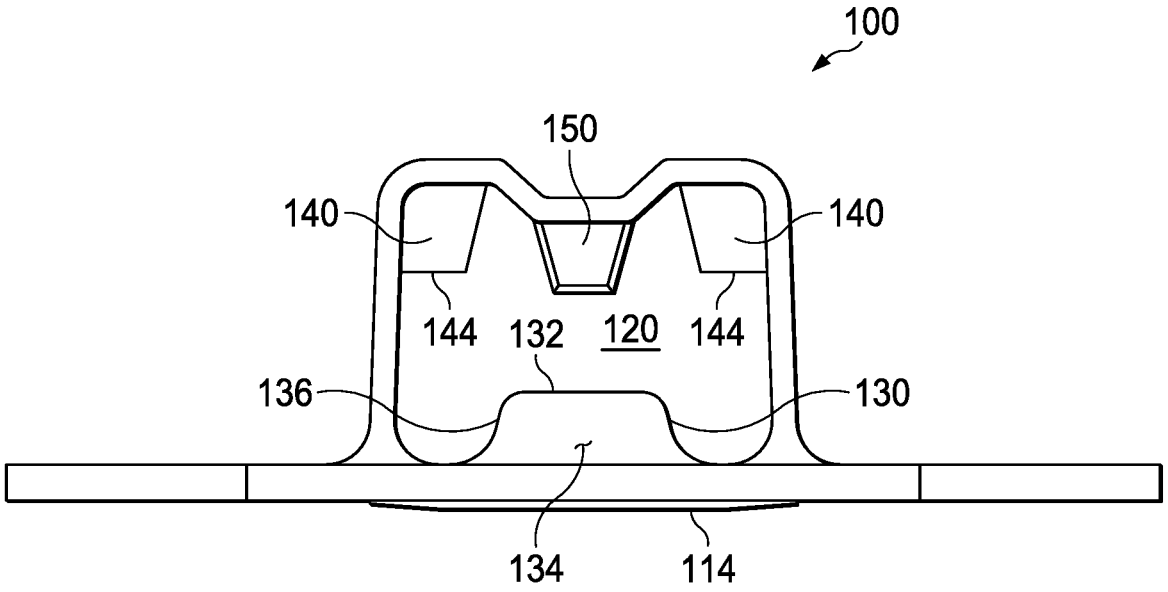
FIG. 11 is a bottom view of the embodiment of the housing of FIG. 10.

FIG. 11 is a bottom view of the embodiment of housing 100 of FIG. 10. Within housing interior 120, and below and opposite to upper guide-stop 130, lower guide-stop 140 is shown in two places, positioned against front 102 and on each side wall 106. Lower guide-stop 140 comprises upper post stop 142 and lower post guide 144. As such, lower guide-stop 140 properly orientates lower post 200 for insertion and engagement with upper guide-stop 130. Lower post block 150 prevents reversed insertion of lower post 200 into housing 100.

Figure 12:
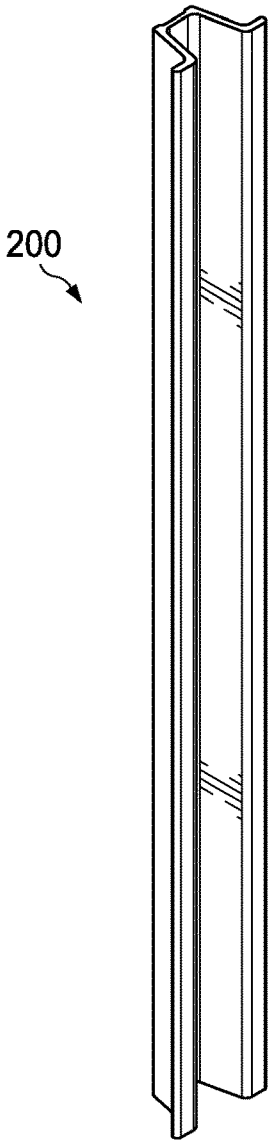
FIG. 12 is an isometric view of an embodiment of the lower post of the guardrail housing and post system illustrated in FIGS. 1 and 2.
Figure 13:
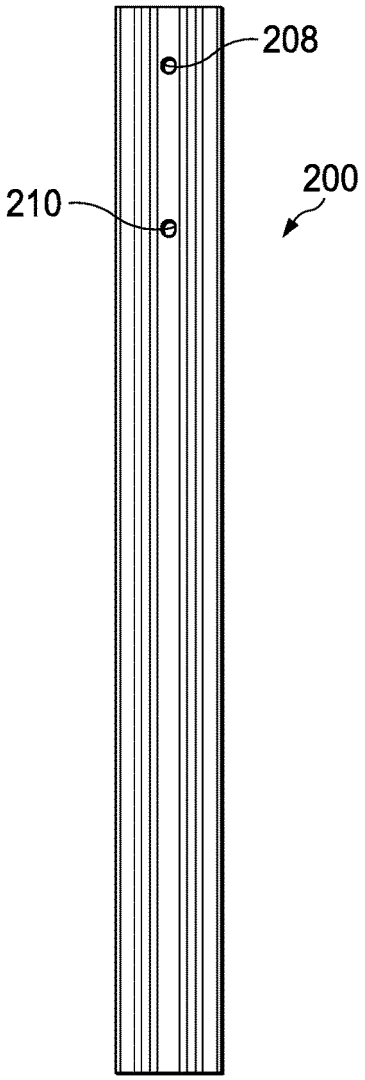
FIG. 13 is a front view of the embodiment of the lower post illustrated in FIG. 12.
Figure 14:
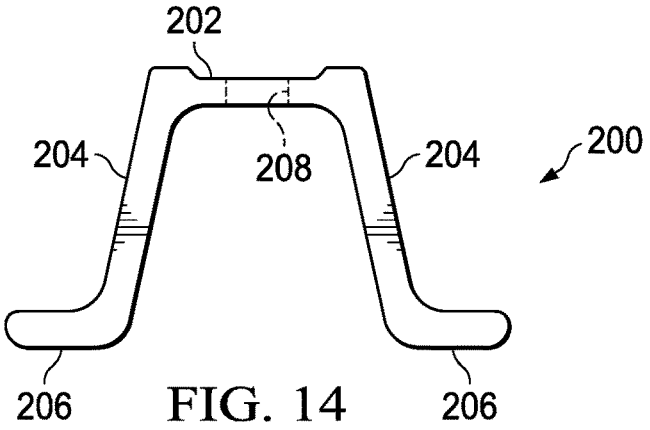
FIG. 14 is a top view of the embodiment of the lower post illustrated in FIG. 12.

FIG. 12 is an isometric view of an embodiment of lower post 200 of the guardrail housing and post system 14 illustrated in FIGS. 1 and 2. FIG. 13 is a front view of this embodiment of lower post 200. FIG. 14 is a top view of this embodiment of lower post 200. Referring to FIGS. 12-14, lower post 200 has a base 202 and side walls 204 extending outward from base 202. Flanges 206 extend outward from the end of each side wall 204, in a plane substantially parallel to base 202. A lower post orifice 208 may be provided at the top of lower post 200 to allow full insertion of lower post 200 into housing 100.

Figure 15:
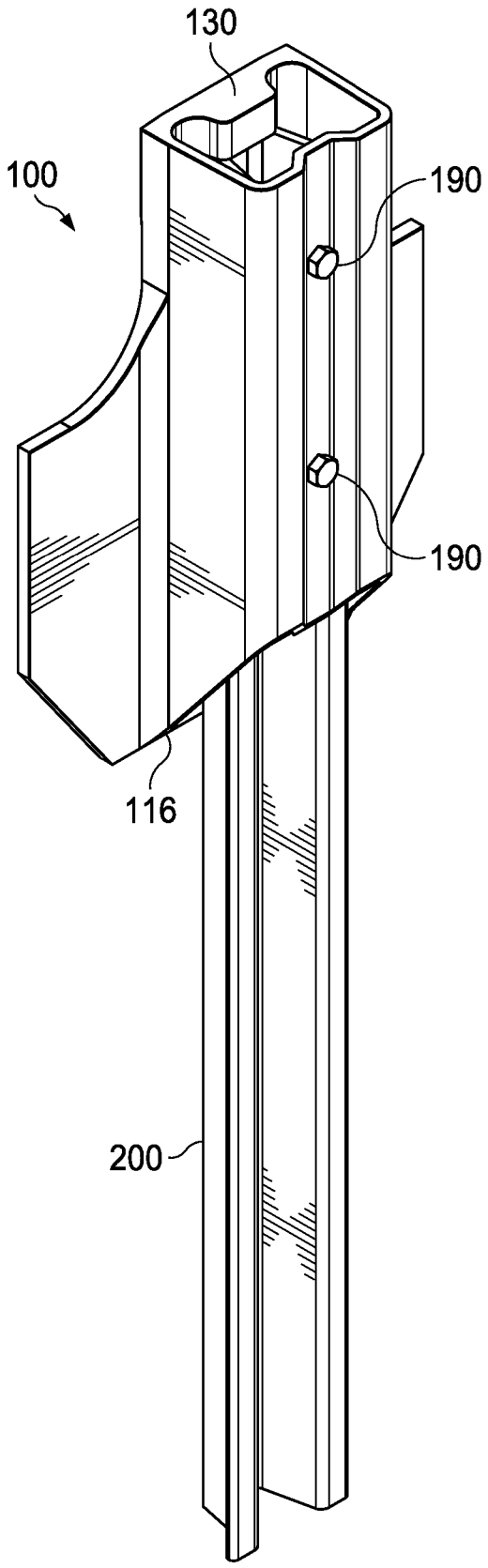
FIG. 15 is an isometric view of a subassembly of an embodiment of the housing shown installed on an embodiment of the lower post.
Figure 16:
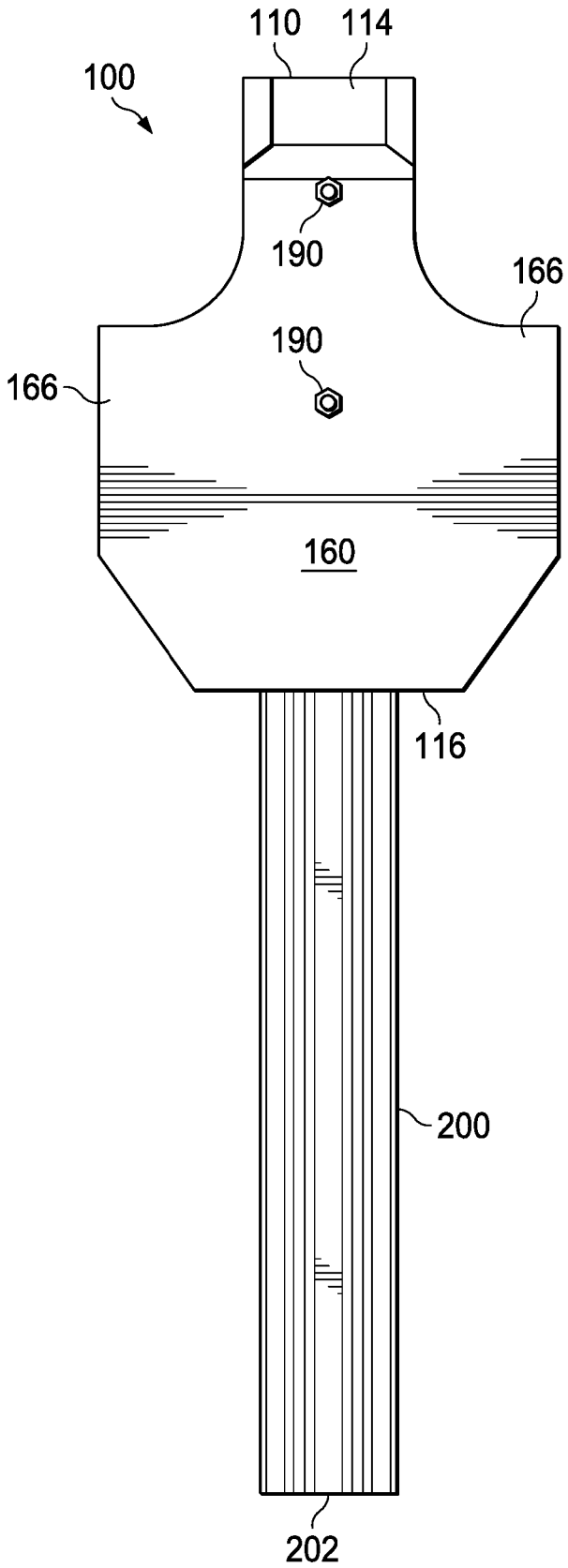
FIG. 16 is a rear view of the housing and lower post subassembly illustrated in FIG. 15.

FIG. 15 is an isometric view of a subassembly of an embodiment of housing 100 shown installed on an embodiment of lower post 200. FIG. 16 is a rear view of housing 100 and lower post 200 of the subassembly illustrated in FIG. 15. Referring to FIGS. 15 and 16, lower post 200 is shown inserted into interior space 120 of housing 100 at lower end 116. Base 202 is aligned proximate to soil plate 160 of housing 100.

In one embodiment, lower post 200 is made of a heavier (per foot) steel ribbed U-channel than upper post 300 steel ribbed U-channel. In another embodiment, lower post 200 is made of a 5 lb. per foot steel ribbed U-channel.

Figure 17:
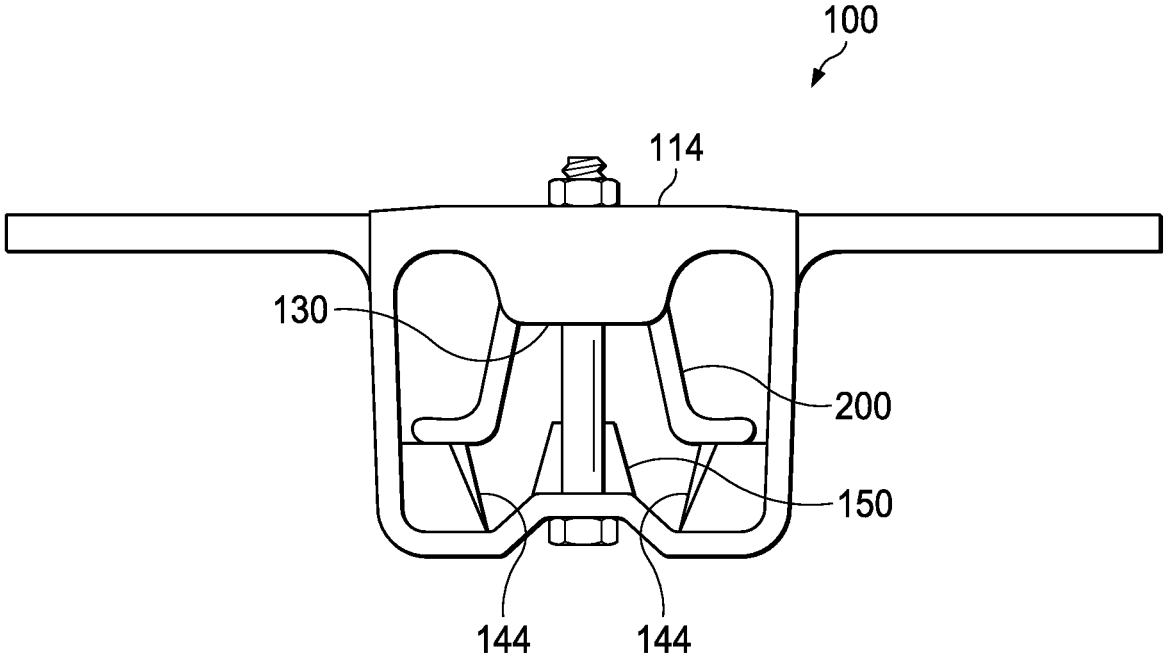
FIG. 17 is a top view of the housing and lower post subassembly illustrated in FIG. 15.
Figure 18:
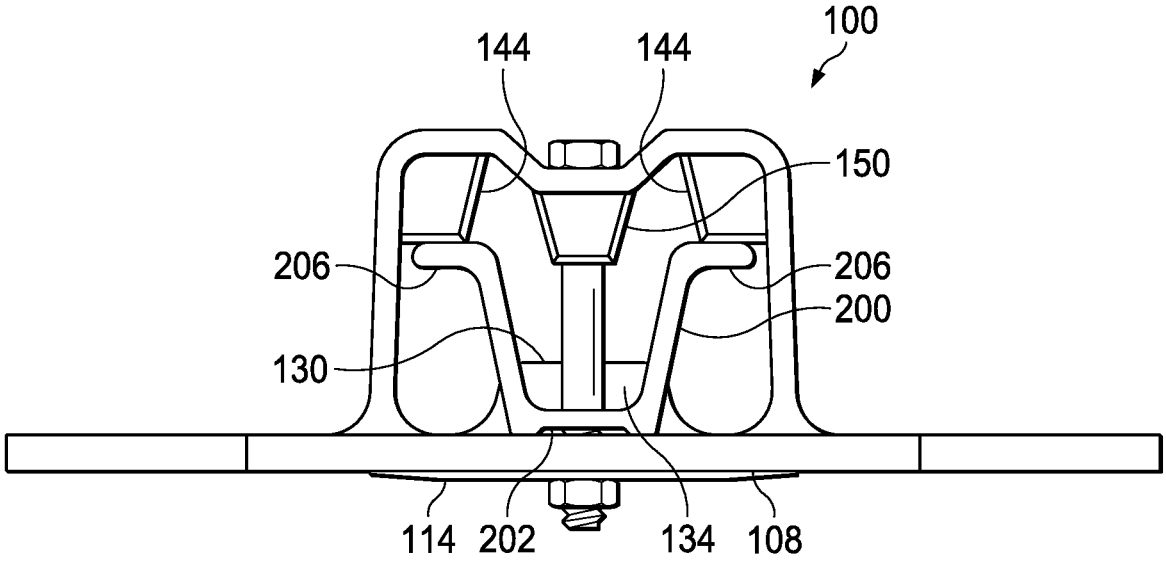
FIG. 18 is a bottom view of the housing and lower post subassembly illustrated in FIG. 15.

FIG. 17 is a top view of the subassembly of housing 100 and lower post 200 illustrated in FIG. 15. FIG. 18 is a bottom view of the subassembly of housing 100 and lower post 200 illustrated in FIG. 15. Referring to FIG. 18, lower post 200 is inserted into interior space 120 of housing 100 with base 202 aligned in sliding relationship with back side 108 of housing 100. Flanges 206 are aligned in sliding relationship with lower post guides 144. In the embodiment illustrated, lower post 200 is aligned for proper insertion. Advantageous to this design, reverse orientation insertion of lower post 200 is prohibited by interference between lower post 200 and lower post block 150 of housing 100.

Lower post 200 is inserted until it abuts lower post stop 134. In this position, housing fasteners 190 may be inserted into one or both housing orifices 180, 182.

In an alternative embodiment, flanges 206 are aligned in sliding relationship with lower guide-stop 140. In the embodiment illustrated, reversed insertion of lower post 200 is prohibited by lower post block 150. As seen in FIGS. 17 and 18, base 202 of lower post 200 engages with lower post stop 134 to properly position lower post 200 inside housing 100. As seen in FIGS. 15-18, housing fasteners 190 secure lower post 200 in engagement with lower post stop 134.

Lower post 200 and housing 100 are installed in the ground until upper end 110 of housing 100 is flush with groundlevel 1. (See FIG. 1). This installation may be accomplished by using a percussive hammer on upper end 110 of housing 100. In particular, the percussive forces may be applied against upper guide-stop 130 (or brace 136).

Figure 19:
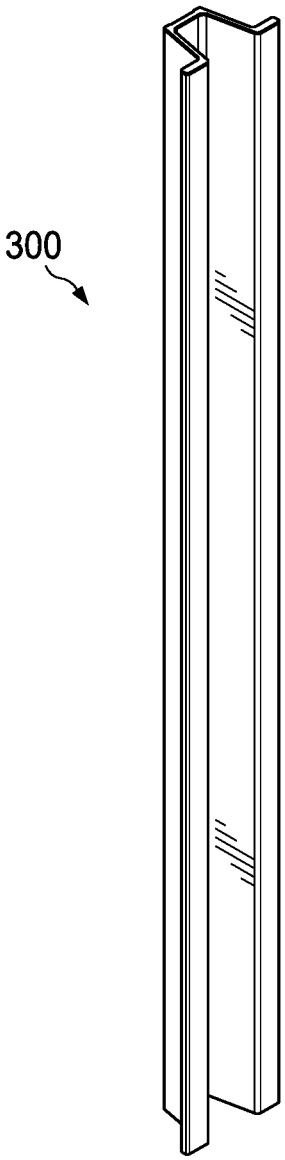
FIG. 19 is an isometric view of an embodiment of the upper post of the guardrail housing and post system illustrated in FIGS. 1 and 2.
Figure 20:
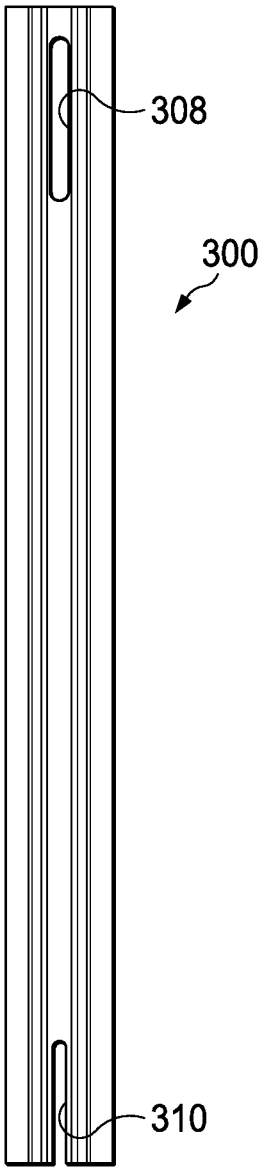
FIG. 20 is a front view of the embodiment of the upper post illustrated in FIG. 19.
Figure 21:
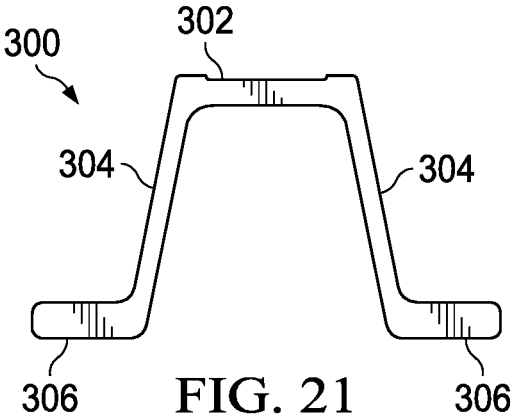
FIG. 21 is a top view of the embodiment of the upper post illustrated in FIG. 19.

FIG. 19 is an isometric view of an embodiment of upper post 300 of the guardrail housing and post system 14 illustrated in FIGS. 1 and 2. FIG. 20 is a front view of the embodiment of upper post 300. FIG. 21 is a top view of the embodiment of upper post 300.

Referring to FIGS. 19-21, upper post 300 has a base 302 and side walls 304 extending outward from base 302. Flanges 306 extend outward from the end of each side wall 304 in a plane substantially parallel to base 302. An upper post orifice 308 is provided at the top of upper post 300 for connection to guardrail 12. An upper post slot 310 is provided at the bottom of upper post 300 to allow full insertion of upper post 300 into housing 100 without interference with a housing fastener 190 extending through interior space 120.

Figure 22:
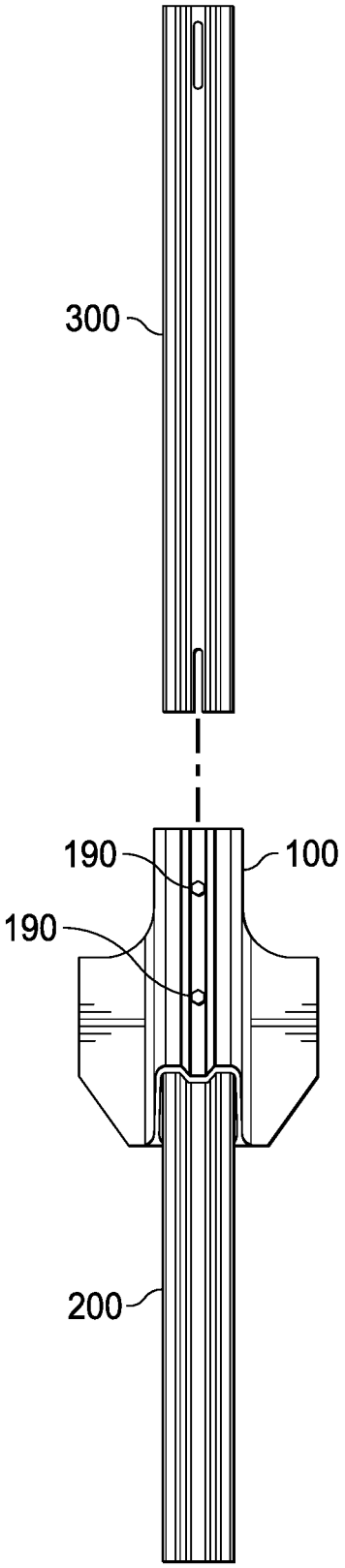
FIG. 22 is an isometric view of an embodiment of the housing, lower post, and upper post assembly, illustrating the upper post before installation.
Figure 23:
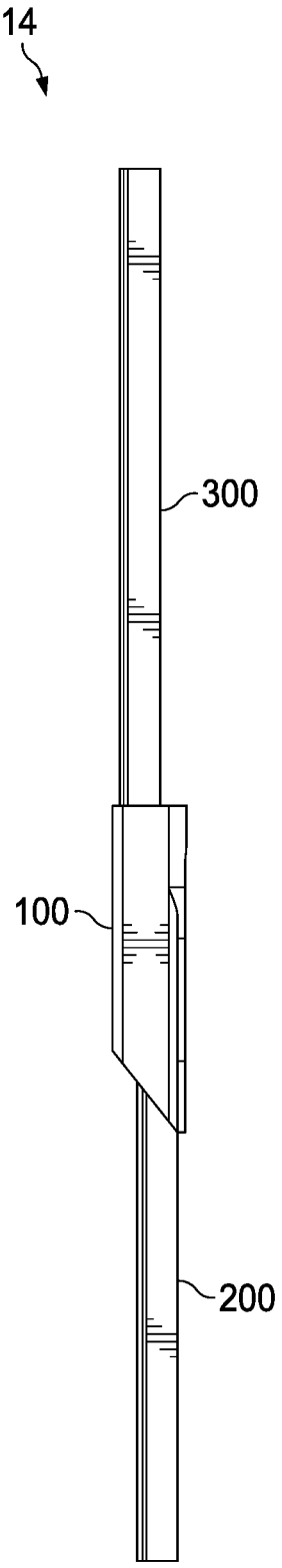
FIG. 23 is a front view of an embodiment of the guardrail housing and post system illustrated in FIG. 22.
Figure 24:
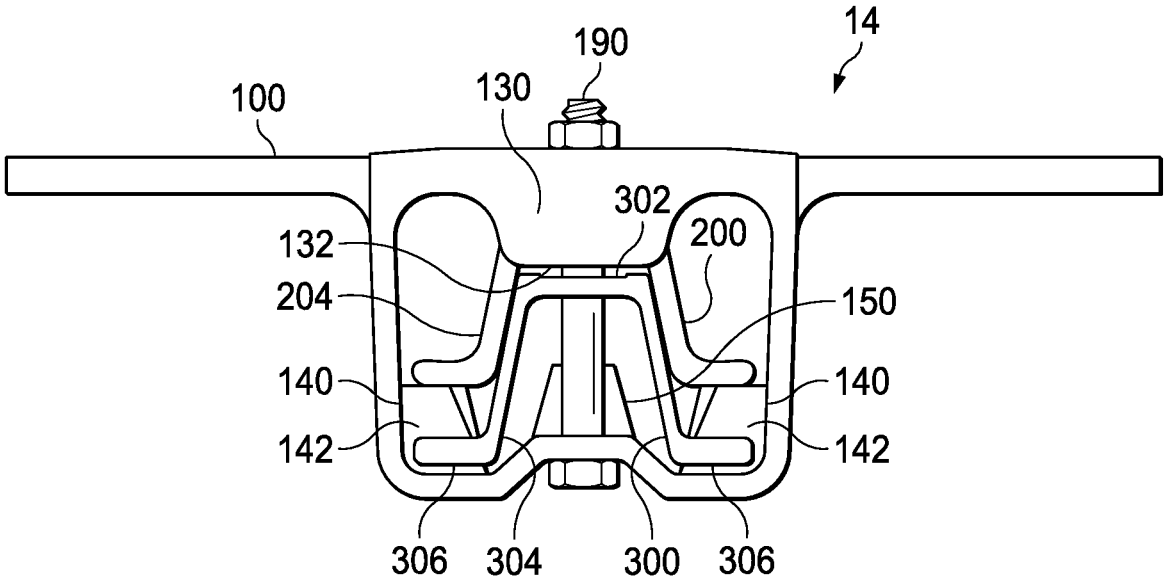
FIG. 24 is a top view of the guardrail housing and post system of FIG. 23.

FIG. 22 is an isometric view of an embodiment of housing 100, lower post 200, and upper post 300 during assembly, illustrating upper post 300 before installation. FIG. 23 is a front view of an embodiment of guardrail housing and post system 14. FIG. 24 is a top view of the embodiment of guardrail housing and post system 14 of FIG. 23.

Referring to FIG. 23, upper post 300 is inserted into interior space 102 of housing 100. Base 302 of upper post 300 is inserted in sliding relationship against upper post guide 132 (or upper guide-stop 130 in the alternative embodiment). Side walls 304 are inserted in-between and in sliding relationship with side walls 204 of lower post 200. Flanges 306 are inserted in sliding relationship to front wall 102 of housing 100. Thus inserted, upper post 300 is constrained to linear movement by upper post guide 132, side walls 204 of lower post 200, and front wall 102 of housing 100. Upper post 300 is constrained from reversed orientation insertion by interference with lower post 200. Insertion of upper post 300 is limited by interference of upper post 300 with upper post stop 142.

In an alternative embodiment, base 302 of upper post 300 is inserted in sliding relationship against upper guide-stop 130. Insertion of upper post 300 is limited by interference of upper post 300 with lower guide-stop 140.

In one embodiment, upper post 300 is made of a 4 lb. per foot steel ribbed U-channel. In another embodiment, upper post 300 extends between 3 and 5 inches into the housing. In another embodiment, upper post 300 extends 4 inches into the housing.

A benefit of the present invention is that by casting the complex design for housing 100, housing 100 can be made affordably and reliably to prevent improper insertion of lower post 200 and upper post 300, meaning lower post 200 and upper post 300 cannot be reversed in location or orientation. This adds significantly to the safety of the system and eliminates miss-assemblies due to these common errors. Additionally, the casting of the complex interior space 120 of housing 100 provides precise insertion limits for lower post 200 and upper post 300. Most importantly, it permits precise control over performance characteristics, such as break-away resistance of upper post 300.

Brace 136 proves a fulcrum for controlled deformation of upper post 300. Collar support 114 provides strength to collar 112 of housing 100 and avoids the need to otherwise oversize the thickness of back side 108 and soil plate 160. The advantage is savings in weight and cost of materials.

Experimentation has determined that a shorter insertion of upper post 300 into housing 100 is easier to repair, but suffers from the upper post falling out too easily on vehicular contact with guardrail 12. A longer insertion prevents pull-out on contact, but may cause upper post 300 to refuse to lift on impact, which is undesirable. Testing has shown the preferred insertion depth is between 3 and 5 inches.

The present invention permits use closer to a slope bordering a road because the activation loads of the system are permitting upper post 300 to deform without destroying the integrity of lower post 200 and housing 100 below the surface 1.

In one embodiment, the lower post is made of a heavier (per foot) steel ribbed U-channel than the upper post steel ribbed U-channel. In one embodiment, the upper post is made of a 4 lb. per foot steel ribbed U-channel, while the lower post is made of a 5 lb. per foot steel ribbed U-channel. It is desirable to have the upper post bend and break more readily than the lower post.

As used herein, the term "substantially" is intended for construction as meaning "more so than not".

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A guardrail post system, comprising:
a housing, the housing comprising;
a lower end and an upper end;
an interior space; and,
a soil plate extending outward from the housing;
the interior of the housing comprising:
a lower post guide; and,
a lower post stop;
a lower post, having a U-channel shape with outwardly extending flanges on its ends;
the lower post being insertable into the lower end of the housing interior, between the lower post guide and a body of the housing, and insertion being limited by engagement with the lower post stop;
an upper post, having a U-channel shape with outwardly extending flanges on its ends;
the upper post being insertable into the upper end of the housing interior, between the lower post and the housing body, and,
the upper post being connectable to a guardrail.

2. The guardrail post system of claim 1, further comprising:
a guardrail connected to the upper post.

3. The guardrail post system of claim 1, further comprising:
an upper post guide; and,
the upper post guide being a surface on the lower post stop.

4. The guardrail post system of claim 1, further comprising:
an upper post guide; and,
the upper post being insertable into the upper end of the housing interior, between the upper post guide and the housing body.

5. The guardrail post system of claim 1, the housing further comprising:
an upper guide-stop comprising:
the lower post stop;
an upper post guide; and,
a brace.

6. The guardrail post system of claim 1, the housing further comprising:
a lower guide-stop comprising:
an upper post stop; and,
the lower post guide.

7. The guardrail post system of claim 1, the housing further comprising:
a lower post block; and
the lower post block preventing reversed insertion of the lower post into the housing.

8. The guardrail post system of claim 1, further comprising:
a housing orifice extending through the housing body;
a lower post orifice on the lower post; and,
a fastener insertable through the housing orifice and the lower post orifice to secure the lower post in the housing and against the lower post stop.

9. The guardrail post system of claim 8, further comprising:
an upper post slot formed on a lower end of the upper post; and,
wherein the fastener passes through the upper post slot to allow insertion of the upper post into the housing; and,
wherein the upper post slot engages an end of the slot to limit insertion and properly position the upper post into the housing.

10. The guardrail post system of claim 8, the upper post further comprising:
an upper post slot for receiving the housing fastener to allow insertion of the upper post into the housing.

11. The guardrail post system of claim 1, further comprising:
an upper post stop; and,
insertion of the upper post is limited by engagement with the upper post stop located in the interior of the housing.

12. The guardrail post system of claim 11, further comprising:
the upper post stop being an upper end surface of the lower post guide.

13. The guardrail post system of claim 1, further comprising:
a brace on the interior of the housing to act as a guide for the upper post, and to permit bending of the upper post without failure of the housing.

14. The guardrail post system of claim 1, further comprising:
a brace forming the lower post stop; and,
wherein the lower post and housing are driven into the ground by percussive force applied to the brace and upper end of the lower post.

15. The guardrail post system of claim 1, further comprising:
the housing further comprising:
a pair of side walls extending perpendicularly upwards from the soil plate; and,
an outer wall spanning between the side walls and having a centrally located longitudinal recess; and,
wherein the recess extends into the U-channel of the upper post when the upper post is inserted into the housing to prevent improper insertion of the upper post and to limit rotation and misalignment of the upper post relative to the housing.

16. The guardrail post system of claim 1, further comprising:

the lower end of the housing being beveled to facilitate insertion into the soil.

17. The guardrail post system of claim 1, the soil plate further comprising:

a lower end and an upper end; and, the lower end of the soil plate having chamfered edges to facilitate insertion into the soil.

18. The guardrail post system of claim 17, the soil plate further comprising:

the upper end of the soil plate being located between the lower end and upper end of the housing.

19. The guardrail post system of claim 1, the housing further comprising:

a collar portion extending above the soil plate;

the collar portion having a collar support located on the back side of the upper end of the housing; and, the collar support being a thickened section that prevents failure of the housing upon bending of the upper post.

20. The guardrail post system of claim 1, further comprising:

a brace located on the interior of a back side of the upper end of the housing.

21. The guardrail post system of claim 1, further comprising:

the housing having a higher tensile strength than the upper post; and, wherein the higher tensile strength of the housing resists bending during insertion and activation.

22. The guardrail post system of claim 1, the upper post further comprising:

a base;

a pair of side walls extending upwards from the base;

a flange extending outward from each side wall; and, an upper post orifice for receiving a guardrail fastener for connecting the upper post to a guardrail.

23. The guardrail post system of claim 1, further comprising:

the upper post being made of a 4 lb. per foot steel ribbed U-channel.

24. The guardrail post system of claim 1, further comprising:

the upper post made of a higher carbon steel than the lower post to permit the upper post to be the first to fracture on an impact with the guardrail post system.

25. The guardrail post system of claim 1, further comprising:

the upper post extending between 3 and 5 inches into the housing.

26. The guardrail post system of claim 1, further comprising:

the upper post extending 4 inches into the housing.

27. The guardrail post system of claim 1, the lower post further comprising:

a base;

a pair of side walls extending upwards from the base; and, a flange extending outward from each side wall.

28. The guardrail post system of claim 1, further comprising:

the lower post being made of a heavier per foot steel ribbed U-channel than the upper post steel ribbed U-channel to enable failure of the upper post without failure of the lower post.

29. The guardrail post system of claim 1, further comprising:

the lower post being made of a 5 lb. per foot steel ribbed U-channel.

30. The guardrail post system of claim 1, further comprising:

the lower post, upper post, and housing are all galvanized.

31. A guardrail post system, comprising:

a housing, the housing comprising;

a lower end and an upper end;

an interior space; and, a soil plate extending outward from the housing;

the interior of the housing comprising:

a lower post guide;

a lower post stop; and, an upper post stop;

a lower post, having a U-channel shape with outwardly extending flanges on its ends;

the lower post being insertable into the lower end of the housing interior, between the lower post guide and a body of the housing, and insertion being limited by engagement with the lower post stop;

an upper post, having a U-channel shape with outwardly extending flanges on its ends;

the upper post being insertable into the upper end of the housing interior, between the lower post and the housing body, and insertion being limited by engagement with the upper post stop; and, the upper post being connectable to a guardrail.

32. A guardrail post system, comprising:

a housing, the housing comprising;

a lower end and an upper end;

an interior space; and, a soil plate located off the off-rail side;

the interior of the housing comprising:

an upper guide-stop comprising a lower post stop and a brace;

a lower guide-stop comprising an upper post stop and a lower post guide;

a lower post, having a U-channel shape with outwardly extending flanges on its ends;

the lower post being insertable into the lower end of the housing interior, between the lower-guide stop and a body of the housing, and insertion being limited by engagement with the upper guide-stop;

an upper post, having a U-channel shape with outwardly extending flanges on its ends;

the upper post being insertable into the upper end of the housing interior, between the upper guide-stop and the housing body, and insertion being limited by engagement with the lower guide-stop; and, the upper post being connectable to a guardrail.

33. The guardrail post system of claim 32, further comprising:

a housing orifice extending through the housing body;

a lower post orifice on the lower post; and, a fastener insertable through the housing orifice and the lower post orifice to secure the lower post in the housing and against the upper guide-stop.

34. The guardrail post system of claim 33, further comprising:

an upper post slot formed on a lower end of the upper post; and, wherein the fastener passes through the upper post slot to allow insertion of the upper post into the housing; and, wherein the upper post slot engages and end of the slot to limit insertion and properly position the upper post into the housing.

35. The guardrail post system of claim 32, the housing further comprising:

a lower post block; and the lower post block preventing reversed insertion of the lower post into the housing.

36. The guardrail post system of claim 32, further comprising:

the housing further comprising:

a pair of side walls extending perpendicularly upwards from the soil plate;

an outer wall spanning between the side walls and having a centrally located longitudinal recess; and, wherein the recess extends into the U-channel of the upper post when the upper post is inserted into the housing to prevent improper insertion of the upper post and to limit rotation and misalignment of the upper post relative to the housing.

37. The guardrail post system of claim 32, further comprising:

the lower end of the housing being beveled to facilitate insertion into the soil.

38. The guardrail post system of claim 32, the soil plate further comprising:

a lower end and an upper end;

the lower end of the soil plate having chamfered edges to facilitate insertion into the soil.

39. The guardrail post system of claim 38, the soil plate further comprising:

the upper end of the soil plate being located between the lower end and upper end of the housing.

40. The guardrail post system of claim 32, the housing further comprising:

a collar portion extending above the soil plate;

the collar portion having a collar support located on the back side of the upper end of the housing;

the collar support being a thickened section that supports the collar from failure upon bending of the upper post.

41. The guardrail post system of claim 32, further comprising:

the housing having a higher tensile strength than the upper post; and, wherein the higher tensile strength of the housing resists bending during insertion and activation.

42. The guardrail post system of claim 32, the upper post further comprising:

a base;

a pair of side walls extending upwards from the base;

a flange extending outward from each side wall;

an upper post orifice for receiving a guardrail fastener for connecting to the upper post to a guardrail; and, an upper post slot for receiving a housing fastener for connecting the upper post to the housing.

43. The guardrail post system of claim 32, further comprising:

the upper post being made of a 4 lb. per foot steel ribbed U-channel.

44. The guardrail post system of claim 32, further comprising:

the upper post made of a higher carbon steel than the lower post to permit the upper post to be the first to fracture on an impact with the guardrail post system.

45. The guardrail post system of claim 32, further comprising:

the upper post extending between 3 and 5 inches into the housing.

46. The guardrail post system of claim 32, further comprising:

the upper post extending 4 inches into the housing.

47. The guardrail post system of claim 32, the lower post further comprising:

a base;

a pair of side walls extending upwards from the base; and, a flange extending outward from each side wall.

48. The guardrail post system of claim 32, further comprising:

the lower post being made of a heavier per foot steel ribbed U-channel than the upper post steel ribbed U-channel to enable failure of the upper post without failure of the lower post.

49. The guardrail post system of claim 32, further comprising:

the lower post being made of a 5 lb. per foot steel ribbed U-channel.

* * * * *